US007207081B2

(12) United States Patent
Gerber et al.

(10) Patent No.: US 7,207,081 B2
(45) **Date of Patent: *Apr. 24, 2007**

(54) RANDOM MOTION CLEANER

(75) Inventors: Douglas E. Gerber, North Canton, OH (US); Kevin L. Thomas, North Canton, OH (US)

(73) Assignee: The Hoover Company, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/169,060

(22) Filed: Jun. 27, 2005

(65) Prior Publication Data

US 2005/0235444 A1 Oct. 27, 2005

Related U.S. Application Data

(63) Continuation of application No. 09/727,724, filed on Dec. 1, 2000, now Pat. No. 6,571,415.

(51) Int. Cl.
*A47L 13/10* (2006.01)

(52) U.S. Cl. ..... 15/98; 15/49.1

(58) Field of Classification Search ..... 15/49.1, 15/97.1, 98, 319, 246; 180/20; 280/28.5
See application file for complete search history.

(56) References Cited

U.S. PATENT DOCUMENTS 1,033,077 A * 7/1912 Ayers ..... 446/458

(Continued)

FOREIGN PATENT DOCUMENTS

| | | | |
|---|---|---|---|
| EP | 1129657 A1 | | 5/2001 |
| EP | 1121889 A2 | | 8/2001 |
| JP | 10-165903 | * | 6/1998 |
| JP | 10-262881 | * | 10/1998 |
| WO | WO 03/003896 A1 | | 1/2003 |
| WO | WO 2004/014210 A1 | | 2/2004 |

OTHER PUBLICATIONS

British Patent Office Search Report relating to British Patent Application No. GB0617559.0 and dated Sep. 21, 2006. This Search Report cites the above-identified Thomas patent, as well as two other patents already of record in the present U.S. Patent Application.

*Primary Examiner*—Terrence R. Till
(74) *Attorney, Agent, or Firm*—A. Burgess Lowe; Michael J. Corrigan

(57) ABSTRACT

A self-propelled floor cleaner is provided having a random motion generator which enhances the maneuverability of the floor cleaner. The random motion generator is rotatably attached to the frame of the cleaner and propels the cleaner across the floor in a random motion. This random motion facilitates cleaning of the floor by making the cleaner easier to manipulate. The random motion generator includes a hollow spherical shell. In the preferred embodiment, the hollow spherical shell houses a weighted motor assembly which is rotatably mounted on a center fixed axle which extends diametrically between the first and second hemispherical halves and is attached thereto. The weighted motor assembly is comprised of a motor housing and a power source, such as batteries or cells. A motor is housed within the motor housing and rotates the motor housing about the center fixed axle. The power source is mounted to one side of the motor housing to provide an unbalanced weight to the motor assembly relative to the fixed center. This unbalanced weight causes the random motion generator to roll across the floor in a random motion and, thus, the floor cleaner is also propelled across the floor in a random motion to facilitate cleaning of the floor.

23 Claims, 3 Drawing Sheets

U.S. PATENT DOCUMENTS 2,046,384 A * 7/1936 Katcher ..... 248/188.1
2,467,139 A * 4/1949 Links et al. ..... 446/219
2,939,246 A * 6/1960 Glos ..... 446/462
2,949,696 A * 8/1960 Easterling ..... 446/462
2,949,697 A * 8/1960 Gunars et al. ..... 446/458
2,977,714 A * 4/1961 Gibson ..... 446/458
3,453,773 A * 7/1969 Compton et al. ..... 446/458
3,500,579 A * 3/1970 Bryer ..... 446/462
3,676,885 A * 7/1972 Wulc ..... 15/1.7
3,798,835 A * 3/1974 McKeehan ..... 446/442
4,173,809 A * 11/1979 Ku ..... 15/319
4,306,329 A * 12/1981 Yokoi ..... 15/319
4,501,569 A * 2/1985 Clark et al. ..... 446/458
4,541,207 A * 9/1985 Antonson ..... 451/508
4,726,800 A * 2/1988 Kobayashi ..... 446/458
5,394,585 A * 3/1995 Connelly ..... 15/246
5,794,305 A 8/1998 Weger
5,893,791 A * 4/1999 Wilkinson ..... 446/456
5,934,968 A * 8/1999 Lin ..... 446/358
6,076,226 A 6/2000 Reed ..... 15/319
6,119,293 A * 9/2000 Phillipson et al. ..... 15/1.7
6,327,741 B1 * 12/2001 Reed ..... 15/319
6,571,415 B2 * 6/2003 Gerber et al. ..... 15/98

* cited by examiner

RANDOM MOTION CLEANER

RELATED APPLICATIONS

This application is a continuation application of U.S. patent application Ser. No. 09/727,724 filed Dec. 1, 2000, now U.S. Pat. No. 6,571,415.

BACKGROUND OF THE INVENTION

1. Field of Invention

This invention pertains to floor cleaners. More specifically, this invention pertains to a self-propelled floor cleaner which utilizes a spherical random motion device to randomly propel a cleaning device about a floor for use in picking up dirt and debris therefrom.

2. Description of Related Prior Art

It is known in the prior art to provide bare floor cleaners for use in removing dust and debris from hardwood floors, linoleum, tile and the like. Examples of such bare floor cleaners are dry mops, stick vacuum cleaners and upright vacuum cleaners. These cleaners have proven adequate for their intended purpose. However, they are known to be cumbersome and difficult to manipulate. Furthermore, these bare floor cleaners do not allow for easy cleaning of the floor surface under furniture without moving the furniture or significant bending or stooping.

It is also known in the prior art to provide self-propelled floor cleaners. These cleaners work well in buildings having wide, open or otherwise well-defined spaces. However, the cleaners are provided with a power cord, which is plugged into an AC receptacle, and the power cord tends to get caught or snagged on furniture and other household objects, thereby, making these cleaners unsuitable for home use.

Hart Enterprises, Inc. produces the Squiggle Ball™, comprising a hollow spherical ball formed of two spherical halves that are threaded together to form a hollow, spherical shell. Once activated, the Squiggle Ball™ randomly rolls along a provided surface. Further, the Squiggle Ball™ utilizes one AA type battery and has a finger actuated, combined push and rotate on/off power switch. The Squiggle Ball cannot be used as a cleaning device and its use is primarily for entertainment of pets and/or children.

In U.S. Pat. No. 4,306,329, a self-propelled cleaning device having an internal power source is disclosed. The cleaning device uses a battery power supply and, thus, the need for a power cord is eliminated. However, the movement of the device is limited to either rotation about its axis at a fixed stationary point or motion in a straight line. This limited motion makes use of the cleaner in a home environment difficult and cumbersome. The cleaner cannot be easily maneuvered around furniture and other household objects.

The present invention utilizes a novel method and apparatus for overcoming these problems. A random motion generator is provided which operatively attaches to a bare floor cleaner to facilitate maneuverability of the cleaner. The random motion generator propels the bare floor cleaner across floors in a random motion. This random motion enables the bare floor cleaner to easily maneuver around furniture and other household objects. Furthermore, this random motion prevents the bare floor cleaner from being caught in corners and other such confined spaces.

SUMMARY OF THE INVENTION

It is therefore an object of the present invention to provide an improved self-propelled bare floor cleaner which is capable of removing dust and debris from a bare floor surface.

It is a further objective of this invention to provide an improved self-propelled bare floor cleaner which requires minimal manual manipulation thereof.

It is still a further objective to provide an improved self-propelled bare floor cleaner capable of cleaning beneath furniture without moving the same.

It is still a further objective to provide an improved self-propelled bare floor cleaner which is easily maneuvered around furniture and other household objects.

These and other objectives of the present invention are achieved by one embodiment of the present invention disclosed herein wherein there is provided a self-propelled bare floor cleaner having a random motion generator for randomly propelling the cleaner across a floor. The random motion generator includes a hollow spherical shell formed from first and second hemispherical halves. The hollow spherical shell houses a weighted motor assembly which is rotatably mounted on a center fixed axle which extends diametrically between the first and second hemispherical halves and is attached thereto. The weighted motor assembly is comprised of a motor housing and a power source, such as batteries or cells. A motor is housed within the motor housing and rotates the motor housing about the center fixed axle. The power source is mounted to one side of the motor housing to provide an unbalanced weight to the motor assembly relative to the fixed center. This unbalanced weight causes the random motion generator to roll across the floor in a random motion and, thus, the bare floor cleaner is also propelled across the floor in a random motion to facilitate cleaning thereof.

BRIEF DESCRIPTION OF THE DRAWINGS

A preferred embodiment of the present invention will-now be described, by way of example, with reference to the accompanying drawings, of which.

DETAILED DESCRIPTION OF THE INVENTION

Figure 1:
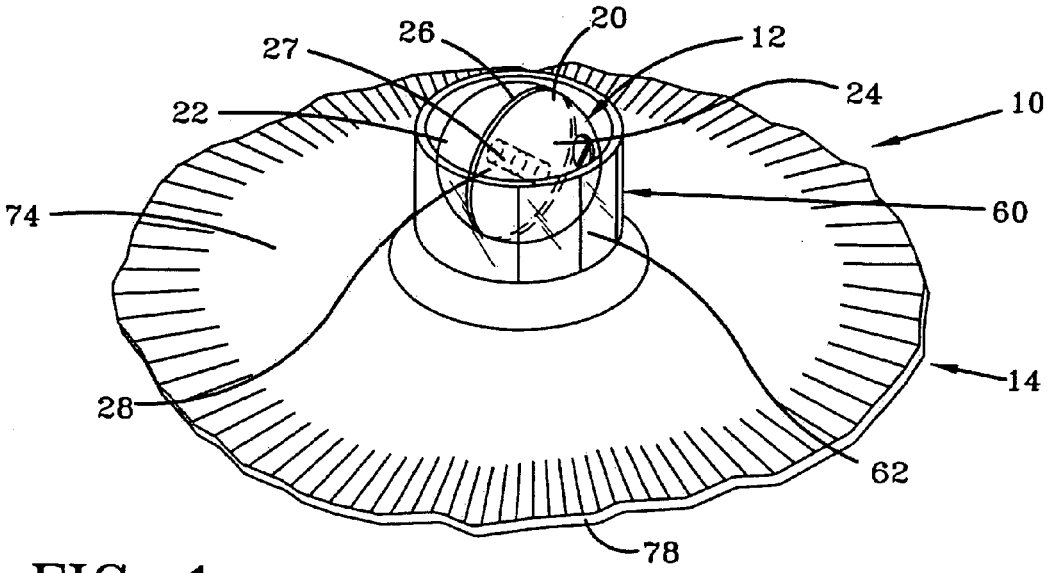
FIG. 1 is a perspective view of a self-propelled bare floor cleaner having a random motion generator according to the present invention.
Figure 2:
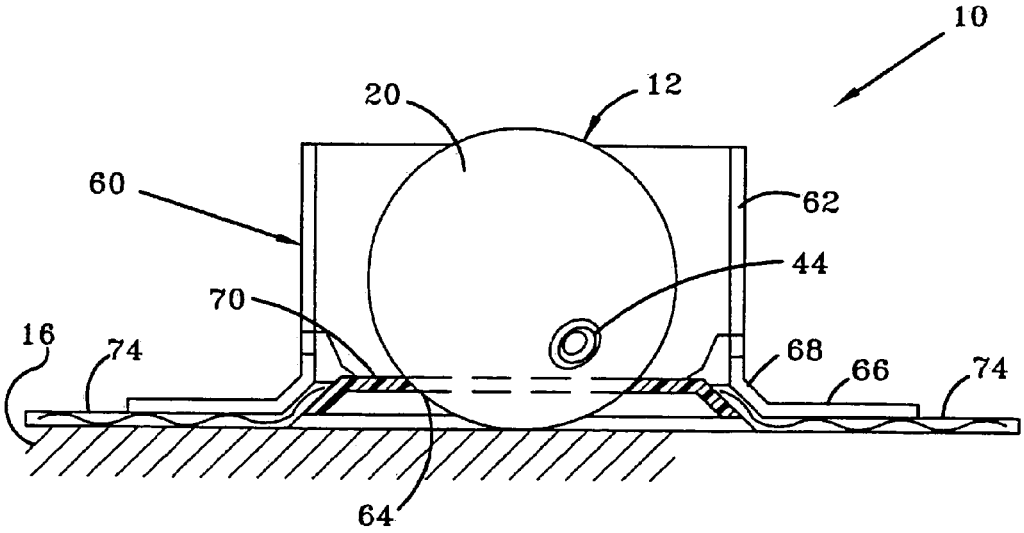
FIG. 2 is a side-sectional view of the self-propelled bare floor cleaner having a random motion generator.

A self-propelled bare floor cleaner 10 having a random motion generator 12 according to a preferred embodiment of the present invention is illustrated by way of example in FIGS. 1 and 2. The floor cleaner 10 is comprised of a cleaning assembly 14 which is randomly propelled over bare floors 16 by the random motion generator 12.

Continuing to view FIGS. 1 and 2, the cleaning assembly 14 includes a frame 60, a means for securing the random motion generator 12 to the frame 60 and a cleaning device, which in the preferred embodiment is dust cloth 74. The frame 60 comprises a cylindrical wall 62 having an open first end 64 and an angled wall section 68 attached thereto and extending downward and outward therefrom. A peripheral lip 66 attaches to the angled wall section 68 and extends outward and parallel to the floor 16. The peripheral lip 66 may comprise patches of Teflon®, felt or other low friction material on its lower surface to facilitate sliding of the frame 60 over the underlying surface 16. Further, the open first end 64 of the cylindrical wall 62 receives the random motion generator 12, and the diameter of the open first end 64 is slightly larger than the diameter of the random motion generator 12, which allows the random motion generator 12 to be positioned within the cylindrical wall 62. The random motion generator 12 is rotatably attached to the frame 60 and is positioned in such a manner as to allow the random motion generator 12 to contact the floor 16 and roll thereon.

Since the diameter of the open first end 64 is larger than the diameter of the random motion generator 12, a securing means is used to secure the random motion generator 12 to the frame 60. In the preferred embodiment, the securing means is comprised of an inner annular lip 70, best seen in FIG. 2. The inner annular lip 70 extends inwardly from the first end of the cylindrical wall 62 and is spaced slightly above the floor 16. Further, the surface of the lip 70 contacting the random motion generator 12 may comprise dimples to decrease friction between the random motion generator 12 and the frame 60. However, any securing means which secures the random motion generator 12 to the frame 60 and allows the random motion generator 12 to roll randomly across the floor 16 is within the scope of this invention. Also, a cover (not shown) may be provided for enclosing the top of the cylindrical frame 60 to further secure the random motion generator 12 therein and to enhance the appearance of the self-propelled bare floor cleaner 10.

The dust cloth 74 has a frayed peripheral edge 78 for picking up dust and debris from the floor 16. Additionally, the dust cloth 74 maybe sprayed with a cleaning solution to enhance the collection of dust and debris. In the preferred embodiment, the dust cloth is removably attached to the frame 60 so that the dust cloth 74 can be removed from the frame 60 and cleaned. In FIG. 2, the dust cloth 74 is removably attached to the bottom surface of the peripheral lip 66 and the angled wall section 68. However, the dust cloth 74 maybe secured to the frame 60 in any manner which allows the dust cloth 74 to adequately contact the floor 16. Similarly, any securing means, such as, hook and loop type fasteners, adhesives, or double sided tapes, maybe used to secure the dust cloth 74 to the frame 60.

Figure 5:
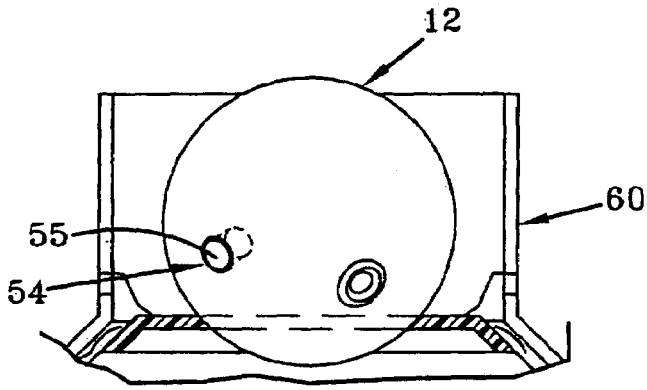
FIG. 5 is a side sectional view of the present invention showing a power switch on the random motion generator in the activated position.
Figure 5A:
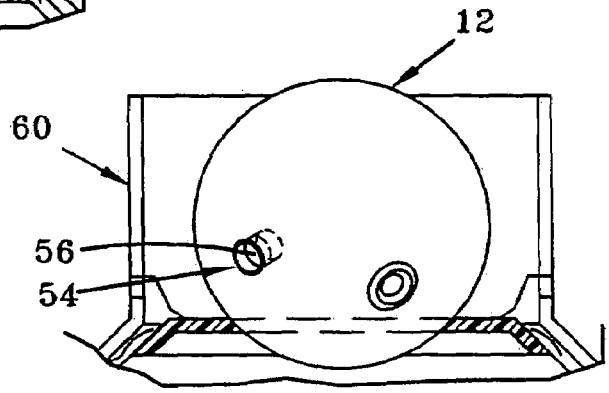
FIG. 5A is a side sectional view of the present invention showing a power switch on the random motion generator in the deactivated position.

Turning now to FIGS. 5 and 5A, the random motion generator 12 may also include a power switch 54 having first and second positions 55, 56 for selectively activating a weighted motor assembly 32, (shown in FIG. 3), as will be explained in further detail below. The power switch 54 may attach to the random motion generator 12 and operatively connect to the weighted motor assembly 32 (shown in FIG. 3). The weighted motor assembly 32 (shown in FIG. 3) is activated by moving the power switch to its first position 55, as seen in FIG. 5. Similarly, the weighted motor assembly 32 (shown in FIG. 3) is deactivated by moving the power switch to its second position 56, as shown in FIG. 5A. No matter what type of power switch 54 is utilized, its activation or first position 55 should not inhibit the random rolling motion of the random motion generator 12 on the underlying surface 16.

With continuing reference to FIGS. 1 and 2, the random motion generator 12 is illustrated. The random motion generator 12 includes a hollow spherical shell 20 which in the preferred embodiment is formed from first and second hemispherical halves 22 and 24. The hemispherical halves 22 and 24 have mated threads for removably securing the hemispherical halves 22 and 24 to each other. However, any means, such as snaps or screws, which removably secures the hemispherical halves 22 and 24 to each other may be used.

In the preferred embodiment, a rubber ring 26 is mounted between the hemispherical halves 22 and 24 and extends outwardly from an outer surface 28 of the spherical shell 20, as shown in FIG. 1. The rubber ring 26 causes the spherical shell 20 to incline slightly to one side or the other and to roll along a slightly curved path. This enhances the random rolling of the random motion generator 12, as will be explained in further detail below.

Figure 3:
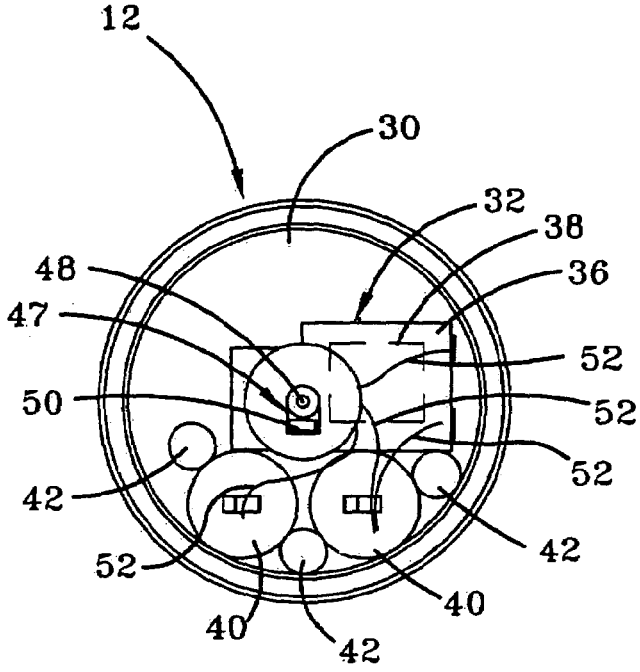
FIG. 3 is a sectional view of the random motion generator.

With reference to FIG. 3, in the preferred embodiment spherical shell 20 has a hollow interior 30 for housing a weighted motor assembly 32. The weighted motor assembly 32 is rotatably mounted on a center fixed axle 27 which extends diametrically across opposing sides of the sphere between the hemispherical halves 22 and 24 of the random motion generator 12 and is attached thereto. The weighted motor assembly 32 is comprised of a motor housing 36 and a power means, such as, batteries 40. A motor 38 is housed within the motor housing 36 and rotates the motor housing 36 about the center fixed axle 27. The batteries 40 are attached to one side of the motor housing 36 to provide an unbalanced weight to the motor assembly 32 relative to the center fixed axle 27 which causes the random motion generator 12 to roll across the floor in a random motion. A plurality of wires 52 extends between the motor and the batteries 40 to provide the necessary electrical connections therebetween.

In the preferred embodiment, weights 42 are attached to the batteries 40 and/or the motor housing 36 on the same side of the motor housing 36 as the batteries 40. This increases the unbalanced weight of the motor assembly 32 relative to the center fixed axle 27 which enhances the random rolling of the random motion generator 12.

In the preferred embodiment, rechargeable batteries 40 are used to power the motor 38. Rechargeable batteries 40 are preferred because they can be recharged without having to disassemble the random motion generator 12, which must be disassembled to replace the non-rechargeable batteries 40. Disassembly of the random motion generator 12 is time consuming and can cause damage to the random motion generator 12.

Figure 4:
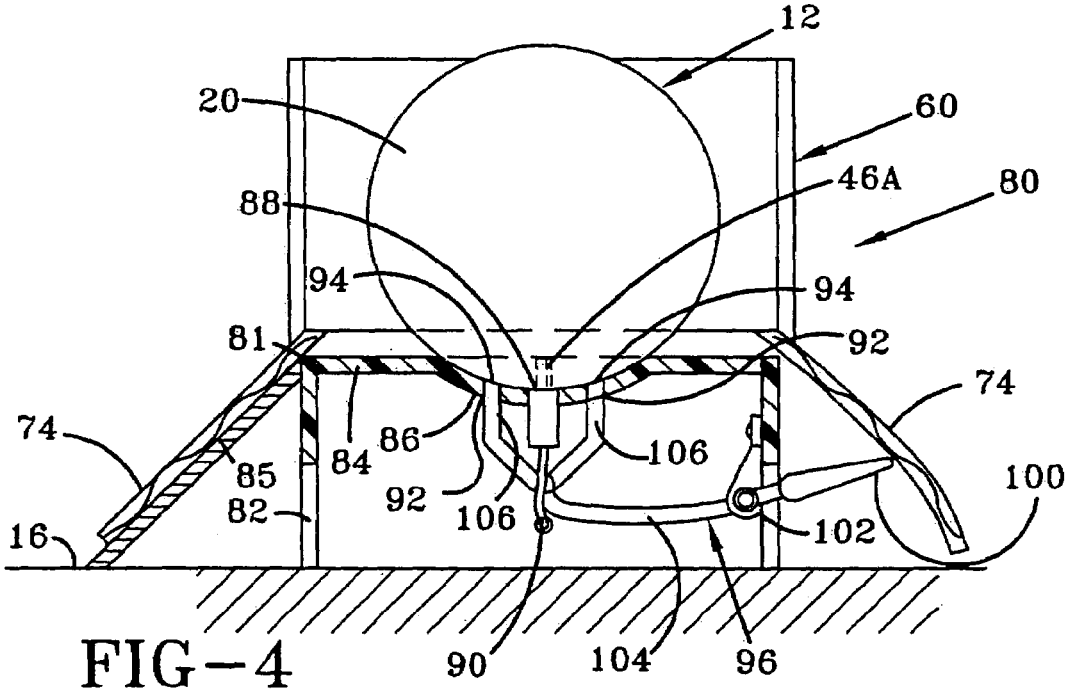
FIG. 4 is a side sectional view of a charging stand for the random motion generator.
Figure 6:
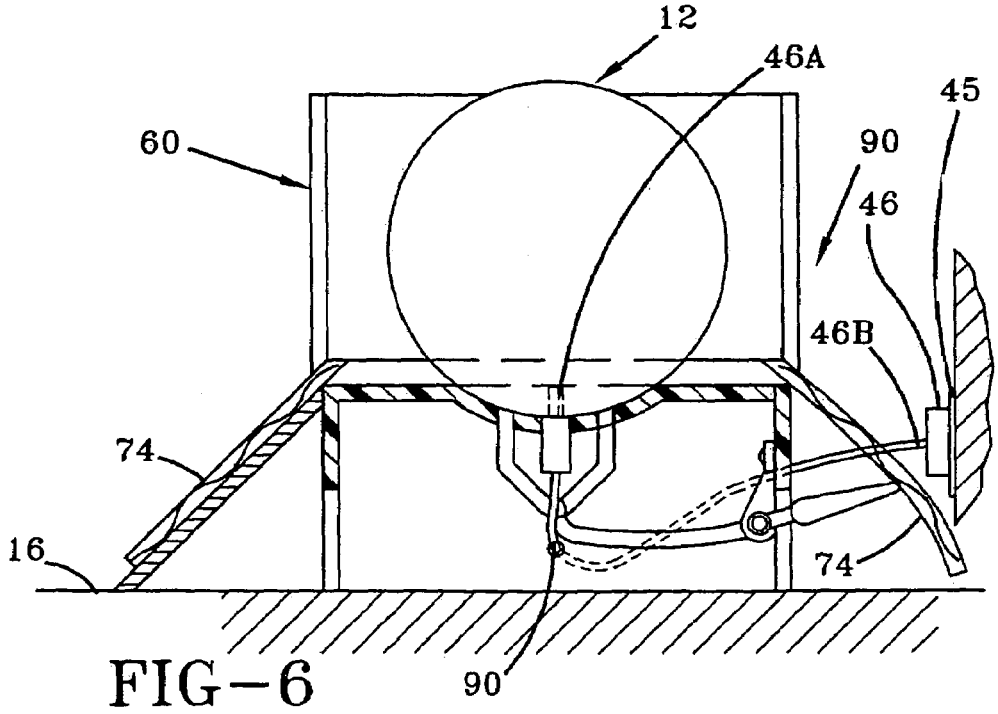
FIG. 6 is a side sectional view of the present invention showing the AC to DC adapter and the AC power receptacle.

With reference to FIGS. 4 and 6, a charging stand 80 for recharging the rechargeable batteries 40 is illustrated. The charging stand 80 is comprised of a cylindrical wall 82 having a first end, a support platform 84, and an AC to DC power adapter 46 having first and second ends 46*a*, 46*b*. The support platform 84 is mounted to the first end 81 of the cylindrical wall 82. The support platform 84 includes a circular indentation 86 for receiving the random motion generator 12 and an opening 88 positioned within the circular indentation 86 for receiving the first end 46*a* of the power adapter 46. Viewing FIG. 6, the second end 46*b* of the power adapter 46 is connected to a power cord 90 which can be plugged into an AC power receptacle 45 to recharge the batteries 40.

The random motion generator 12 has a receiving mechanism 47 for receiving the DC charge and transmitting it to the batteries 40, as shown in FIG. 3. The receiving mechanism 47 includes a receptacle 48 for receiving the first end 46*a* of the power adapter 46 and a switch 50. The receptacle 48 is mounted on the motor assembly 32 and positioned within an opening 44 located on either the first or the second hemispherical half 22 and 24 of the random motion generator 12. During periods of non-use, the random motion generator 12 is recharged by plugging the first end 46*a* of the power adapter 46 into the receptacle 48, which has a complimentary shape. When the first end 46*a* of the power adapter 46 is plugged into the receptacle, the switch, which is positioned adjacent to the receptacle 48, turns the motor assembly 32 off to enable recharging of the batteries 40. A plurality of wires 52 extends between the motor 38, batteries 40, receptacle 48 and switch 50 to provide the necessary electrical connectors therebetween.

In the preferred embodiment, the charging stand 80 includes an ejection assembly 96, as shown in FIG. 4. During periods of use, the ejection assembly 96 is used to remove the random motion generator 12 from the charging stand 80. The ejection assembly 96 is comprised of an ejection arm 106, a linkage arm 104 having first and second ends, a support 102 and a foot pedal 100. The ejection arm 106 extends through two apertures 92 in the support platform 84. The apertures 92 are positioned diametrically opposite one another with the opening 88 formed therebetween. The ejection arm 106 is attached to the first end of the linkage arm 104 and the second end of the linkage arm 104 is attached to the support 102. The foot pedal 100 is pivotally mounted to the support 102. When the foot pedal 100 is depressed, the ejection arm 106 is projected through the apertures 92 in the support platform 84 and contacts the random motion generator 12. The ejection arm 106 exerts an upward force on the random motion generator 12 which results in the random motion generator 12 being ejected from the charging stand 80. When the random motion generator 12 is ejected from the charging stand 80, the first end 46*a* of the AC to DC power adapter 46 is removed from the receptacle 48 which activates the switch 50 and turns the random motion generator 12 onto facilitate use of the bare floor cleaner 10. A ramp 85 maybe operatively attached to the cylindrical wall 82 and/or the support platform 84 to facilitate removal of the random motion generator 12 from the charging stand 80 by allowing the random motion generator 12 to roll down the ramp 85 to the floor 16 without damage.

In FIG. 4, the random motion generator 12 is shown without the cleaning assembly 14. However, the cleaning assembly 14 may be attached to the random motion generator 12 during charging of the random motion generator 12 on the charging stand 80.

A method of using the self-propelled bare floor cleaner 10 according to the present invention includes the steps of activating the weighted motor assembly 32 either by depressing the foot pedal 100 to eject the random motion generator 12 from the charging stand 80, thereby, causing the switch 50 to activate the weighted motor assembly 32 or by moving the power switch 54 to the first position 55 to activate the weighted motor assembly 32, contacting the spherical shell 20 with the floor 16 and randomly propelling the bare floor cleaner 10 across the floor 16 to pick up dirt and debris therefrom.

The present invention has been described above using a preferred embodiment by way of example only. Obvious modifications within the scope of the present invention will become apparent to one of ordinary skill upon reading the above description and viewing the appended drawings. The present invention described above and as claimed in the appended claims is intended to include all such obvious modifications within the scope of the present invention.

What is claimed is:

1. A self-propelled bare floor cleaner, comprising:

a dusting assembly; and a random motion generator operatively connected to said dusting assembly, said dusting assembly comprising:

a frame having a wall, wherein said wall is cylindrical and has a first end, said first end of said cylindrical wall defining a first cylinder wall opening having a diameter larger than the diameter of the random motion generator, wherein said first cylindrical wall opening receives the random motion generator, said frame further including an angled wall section attached to the first end of the cylindrical wall and extending outwardly therefrom and a peripheral lip attached to the angled wall section;

a securing mechanism for securing the random motion generator within the frame; and a dusting cloth attaching to the frame;

wherein said random motion generator is secured within said frame a pre-determined distance from said frame.

2. The self-propelled bare floor cleaner of claim 1, wherein said random motion generator includes:

a hollow substantially spherical shell rotatably attached to the frame; and a weighted motor assembly having a motor for rotating the random motion generator and rotatably attached to a center fixed axle, the center fixed axle extending diametrically across opposing sides of said spherical shell.

3. The self-propelled bare floor cleaner of claim 2, further comprising:

a power switch having first and second positions, the power switch operatively connected to the weighted motor assembly, wherein when the power switch is in the first position, the weighted motor assembly is activated and when the power switch is in the second position, the weighted motor assembly is deactivated.

4. The self-propelled bare floor cleaner of claim 2, wherein the random motion generator includes a rubber ring operatively mounted on the perimeter of said spherical shell.

5. The self-propelled bare floor cleaner of claim 2, wherein said hollow substantially spherical shell includes first and second hemispherical halves.

6. The self-propelled bare floor cleaner of claim 2, wherein said weighted motor assembly includes a motor housing for housing the motor and a power source being operatively mounted to one side of the motor housing to provide an unbalanced weight to the weighted motor assembly.

7. The self-propelled bare floor cleaner of claim 6, wherein at least one weight is operatively mounted to the same side of the weighted motor assembly as the power source.

8. The self-propelled bare floor cleaner of claim 6, wherein the power source is at least one battery.

9. The self-propelled bare floor cleaner of claim 8, wherein the at least one battery is rechargeable.

10. The self-propelled bare floor cleaner of claim 9, wherein the random motion generator includes a receiving mechanism for recharging the rechargeable battery.

11. The self-propelled bare floor cleaner of claim 10, wherein the receiving mechanism includes:

a receptacle operatively connected to the weighted motor assembly and fixedly positioned with a first opening of the random motion generator; and, a switch operatively connected to the receptacle and the weighted motor assembly, wherein when an AC to DC power adapter contacts the receptacle, the switch turns the weighted motor assembly off to facilitate charging of the at least one battery, and when the AC to DC power adapter is removed from the receptacle, the switch turns the weighted motor assembly on to facilitate use of the bare floor cleaner.

12. The self-propelled bare floor cleaner of claim 1, wherein the securing mechanism for securing the random motion generator within the frame includes an inner lip, the inner lip operatively attaching to the first end of the cylindrical wall of the frame.

13. A self-propelled bare floor cleaner, comprising:

a cleaning assembly; and a random motion generator operatively connected to said cleaning assembly, said cleaning assembly comprising:

a frame having a wall;

a securing mechanism for securing the random motion generator within the frame; and a cleaning device attaching to the frame; said random motion generator includes:

a hollow substantially spherical shell rotatably attached to the frame about a center fixed axle; and a weighted motor assembly having a motor for rotating the random motion generator and rotatably attached to the center fixed axle, the center fixed axle extending diametrically across opposing sides of said spherical shell, wherein said frame is located a pre-determined distance from the center fixed axle of said spherical shell.

14. The self-propelled bare floor cleaner of claim 13, wherein said weighted motor assembly includes a motor housing for housing the motor and a power source being operatively mounted to one side of the motor housing to provide an unbalanced weight to the weighted motor assembly.

15. The self-propelled bare floor cleaner of claim 14, further comprising:

a power switch having first and second positions, the power switch operatively connected to the weighted motor assembly, wherein when the power switch is in the first position, the weighted motor assembly is activated and when the power switch is in the second position, the weighted motor assembly is deactivated.

16. The self-propelled bare floor cleaner of claim 14, wherein the random motion generator includes a rubber ring operatively mounted on the perimeter of said spherical shell.

17. The self-propelled bare floor cleaner of claim 14, wherein at least one weight is operatively mounted to the same side of the weighted motor assembly as the power source.

18. The self-propelled bare floor cleaner of claim 14, wherein the power source is at least one battery.

19. The self-propelled bare floor cleaner of claim 18, wherein the at least one battery is rechargeable.

20. The self-propelled bare floor cleaner of claim 19, wherein the random motion generator includes a receiving mechanism for recharging the rechargeable battery.

21. The self-propelled bare floor cleaner of claim 20, wherein the receiving mechanism includes:

a receptacle operatively connected to the weighted motor assembly and fixedly positioned within a first opening of the random motion generator; and, a switch operatively connected to the receptacle and the weighted motor assembly, wherein when an AC to DC power adapter contacts the receptacle, the switch turns the weighted motor assembly off to facilitate charging of the at least one battery, and when the AC to DC power adapter is removed from the receptacle, the switch turns the weighted motor assembly on to facilitate use of the bare floor cleaner.

22. The self-propelled bare floor cleaner of claim 13, wherein the frame includes:

a cylindrical wall having a first end, the first end of the cylindrical wall forming a first cylindrical wall opening having a diameter larger than the diameter of the random motion generator, the first cylindrical wall opening receiving the random motion generator;

an angled wall section attached to the first end of the cylindrical wall and extending outwardly therefrom; and, a peripheral lip attached to the angled wall.

23. The self-propelled bare floor cleaner of claim 13, wherein the securing mechanism for securing the random motion generator within the frame includes an inner lip, the inner lip operatively attaching to the first end of the cylindrical wall of the frame.

* * * * *